US006074262A

United States Patent [19]

Shin

[11] Patent Number: 6,074,262

[45] Date of Patent: Jun. 13, 2000

[54] METHOD AND APPARATUS FOR AUTOMATICALLY SUPPLYING SIGNAL IN A VIDEO DISPLAY DEVICE

[75] Inventor: Jung-ho Shin, Suwon, Rep. of Korea

[73] Assignee: Samsung Electronics Co., Ltd., Suwon, Japan

[21] Appl. No.: 09/110,272

[22] Filed: Jul. 6, 1998

[30] Foreign Application Priority Data

Jul. 4, 1997 [KR] Rep. of Korea ..... 97 30928

[51] Int. Cl.[7] ..... F23Q 23/08

[52] U.S. Cl. ..... 445/3 B; 445/63

[58] Field of Search ..... 445/36, 63

[56] References Cited

U.S. PATENT DOCUMENTS

| | | |
|---|---|---|
| 4,757,239 | 7/1988 | Starkey, IV . |
| 4,790,785 | 12/1988 | Lee et al. . |
| 4,925,421 | 5/1990 | van den Broek . |
| 4,950,192 | 8/1990 | Rietdijk et al. . |
| 5,216,504 | 6/1993 | Webb et al. . |
| 5,310,038 | 5/1994 | Akaike et al. . |
| 5,325,196 | 6/1994 | Yoshimi et al. . |
| 5,442,391 | 8/1995 | Hung et al. . |
| 5,448,288 | 9/1995 | Oue et al. . |
| 5,526,043 | 6/1996 | Wen ..... 348/190 |
| 5,638,461 | 6/1997 | Fridge . |
| 5,653,324 | 8/1997 | Toeniskoetter . |
| 5,675,235 | 10/1997 | Nagai . |
| 5,677,732 | 10/1997 | Moon . |
| 5,741,985 | 4/1998 | Gaete . |
| 5,742,338 | 4/1998 | Nose . |

*Primary Examiner*—Vip Patel
*Assistant Examiner*—Todd Reed Hopper
*Attorney, Agent, or Firm*—Robert E. Bushnell, Esq.

[57] ABSTRACT

A method and an apparatus for automatically supplying a pattern signal for testing and adjusting a screen of a video display device such as a cathode ray tube (CRT) assembly. When a pallette stops at a certain working position, the pallette is pushed to the direction vertical to a transporting direction of a conveyor belt and toward the operator and then fixed. Afterwards, due to the operation of a cylinder, connecting rods and a pattern signal supply terminal are connected to a connector which is electrically connected to the CRT assembly, and thereby the pattern signal for testing and adjusting the screen is supplied. The mobility in every direction generated in moving the connecting rods by the operation of the cylinder is properly controlled by an elastic element. In addition, by buffering the rapid rectilinear movement of a piston rod caused by the operation of the cylinder, the pattern signal supply terminal is smoothly connected to the connector for testing and adjusting the screen of the CRT assembly.

27 Claims, 6 Drawing Sheets

METHOD AND APPARATUS FOR AUTOMATICALLY SUPPLYING SIGNAL IN A VIDEO DISPLAY DEVICE

CLAIM FOR PRIORITY

This application makes reference to, incorporates the same herein, and claims all benefits accruing under 35 U.S.C. §119 from an application for METHOD AND APPARATUS FOR AUTOMATICALLY SUPPLYING SIGNAL IN A VIDEO DISPLAY DEVICE earlier filed in the Korean Industrial Property Office on Jul. 4, 1997, and there duly assigned Ser. No. 30928/1997, a copy of which application is annexed hereto.

BACKGROUND OF THE INVENTION

1. Technical Field

The present invention relates to a method and an apparatus for automatically supplying a pattern signal for testing a video display device and, more particularly to a method and an apparatus for automatically supplying a pattern signal necessary for testing and adjusting a screen of a video display device such as a cathode ray tube (CRT) assembly in a product manufacturing line.

2. Related Art

Generally, a video display device such as a cathode ray tube (CRT) as manufactured, for example, in U.S. Pat. No. 4,790,785 for Means And Method For Manufacture For A High Resolution Color Cathode Ray Tube issued to Lee et al., U.S. Pat. No. 4,950,192 for Method Of Manufacturing Of Color Display Tube issued to Rietdijk et al., and U.S. Pat. No. 4,925,421 for Method For Manufacturing A Color Cathode Ray Tube And A Color Cathode Ray Tube issued to van den Broek, must be tested and adjusted to correct display deviations and distortions in a production assembly line.

Conventionally, the test and adjustment of display deviations and distortions of a CRT assembly mainly rely upon physical labor. The CRT assembly must pass though a series of essential tests and adjustments in a production assembly line. Exemplars of testing techniques of CRT assembly in a production assembly line are disclosed in U.S. Pat. No. 4,757,239 for CRT Display System With Automatic Alignment Employing Personality Memory issued to Starkey, IV, U.S. Pat. No. 5,216,504 for Automatic Precision Video Monitor Alignment System issued to Webb et al., U.S. Pat. No. 5,442,391 for Method And A System For Testing A Cathode Ray Tube Or Like Products issued to Hung et al., U.S. Pat. No. 5,526,043 for Automatic Video Display Testing And Adjusting System issued to Wen, and U.S. Pat. No. 5,638,461 for Stereoscopic Electro-Optical System For Automated Inspection And/Or Alignment Of Image Devices On A Production Assembly Line issued to Fridge.

During a process of adjusting a screen of the CRT assembly, a human operator supplies a variety of test signals from a measurement instrument to the CRT assembly through a signal cable and a microprocessor cable for testing and adjustment, i.e., a vertical synchronization signal, a horizontal synchronization signal and a direct digital control (DDC) signal. After the screen of the CRT assembly is tested and adjusted, the operator must physically separate the signal cable and the microprocessor cable and transport the signal cable and the microprocessor cable to a next operating line. Since the operator must manually connect and separate the microprocessor cable and the signal cable of the CRT assembly to/from the measurement instrument, I have observed that the screen testing and adjustment can be extremely cumbersome and inconvenient. Moreover, as the working hours are increased for the operator at the production assembly line, the test time is increased and the production quality is lowered.

SUMMARY OF THE INVENTION

Accordingly, it is therefore an object of the present invention to provide an apparatus for automatically supplying a test signal to a video display device for testing and adjusting a screen in a production assembly line.

It is also an object to provide an apparatus for automatically supplying a test signal to a video display device for testing and adjusting a screen without human intervention.

It is another object to provide an automation system of a production assembly line for testing and adjusting a screen of a video display device independently of an operator.

According to one aspect of the present invention, a method of automatically supplying a test pattern signal for testing and adjusting a screen of a video display device requires that, when a pallette stops at a certain operating position of a production assembly line, a terminal supporting/transporting unit connected electrically to a measurement instrument is automatically moved and electrically connected to a connector which is fixed on the pallette and electrically connected to the video display device. A test pattern signal for testing and adjusting the screen is supplied to the connector connected to the terminal supporting/transporting unit, and is displayed on the screen of the video display device. After testing and adjusting the screen of the video display device, the terminal supporting/transporting unit is separated from the connector and the pallette is transported to the next operating line. For safe operation, after the pallette stops at a certain working position, the pallette is pushed to the direction vertical to the transporting direction of a conveyor belt toward the operator and then fixed.

According to another aspect of the present invention, in a method for automatically supplying the signal, when the pallette stops at a certain operating position of a production assembly line, the pallette is pushed to the direction vertical to the transporting direction of a conveyor belt toward the operator and then fixed. After adjusting the connection position of the terminal supporting/transporting unit electrically connected to the measurement instrument and the connector which is fixed at the pallette and connected electrically to the video display device, the connection distance of the terminal supporting/transporting unit to the connector is adjusted based on the video display device. By moving the terminal supporting/transporting unit to the connector by a certain distance, the terminal supporting/transporting unit and the connector are electrically connected. Afterwards, the pattern signal for testing and adjusting the screen of the video display device is supplied to the connector connected to the terminal supporting/transporting unit, and the pattern signal is displayed on the screen of the video display device. After testing and adjusting the screen state of the video display device, the connector is separated from the terminal supporting/transporting unit, and the pallette is transported to the next operating line. The position of the terminal supporting/transporting unit can be adjusted in every direction so that the connector can accurately be connected to the terminal supporting/transporting unit. In addition, the connection distance between the connector and the terminal supporting/transporting unit can be adjusted based on the position of the connector established corresponding to the size of the pallette which varies according to the screen size of the video display device.

According to another aspect of the present invention, an apparatus for automatically supplying a test pattern signal for testing and adjusting a screen of a video display device includes: a connector which is established on the pallette and electrically connected to the video display device; a supporting unit which is extended to the outer side from a frame of the conveyor belt facing the pallette; a driving force generating unit which is fixed at the supporting unit facing the connector and generates the driving force; a driving force transmitting unit for transmitting the driving force generated by the driving force generating unit; a terminal supporting/transporting unit which is fixed at the driving force transmitting unit maintaining a certain distance to the connector and electrically connected/separated to/from the connector through the rectilinear movement by the driving force; and a measurement instrument which is connected electrically to the terminal supporting/transporting unit and generates the pattern signal for testing and adjusting the screen of the video display device.

Preferably, the driving force generating unit includes: a cylinder mounted on the supporting unit; and a piston rod which performs the rectilinear movement from the cylinder. The driving force transmitting unit includes: a pressing unit which is fixed at the forehead of the piston rod and performs the rectilinear movement toward the connector along the upper surface of the supporting unit by the operation of the cylinder; a shock absorbing unit for absorbing the driving force of the pressing unit; and a guide plate which is protrusively formed at the center of the upper surface of the supporting unit in the longitudinal direction and guides the rectilinear movement of the terminal supporting/transporting unit.

Preferably, the shock absorbing unit includes: a pair of guide bars which are fixed at both ends of the pressing unit in the longitudinal direction; and a shock absorbing pipe which has one end to which the guide bar is slidably inserted and the other end which is closed, forms a screw at the outer peripheral surface and is connected to a bracket fixed on the upper surface of the supporting unit with the screw. The shock absorbing unit further includes a shock absorption control unit for controlling the absorbing capability of the shock absorbing unit. As the shock absorption control unit, a knob attached to the other end of the shock absorbing pipe can be used.

The terminal supporting/transporting unit includes: a transportation guide unit which is attached to the pressing unit and performs the rectilinear movement toward the connector along the guide plate by the transmitted driving force; a buffer unit which is elastically connected to the transportation guide unit and moves right and left when the transportation guide unit performs the rectilinear movement; and a terminal fixing unit which is electrically connected to the measurement instrument and elastically connected to the upper part of the buffer unit and is connected/separated to/from the connector moving up and down, when the transportation guide unit performs the rectilinear movement.

Preferably, the transportation guide unit includes: a first supporting plate which is fixed at the pressing unit of the driving force transmitting unit; a pair of guide rails which are formed at the bottom of the first supporting plate apart from each other by a certain distance and are connected slidably to the guide plate of the supporting unit; vertical supporting walls which are protrusively formed upwardly at both ends of the upper surface of the first supporting plate; a horizontal supporting bar having both ends fixed at the vertical supporting walls and supports the buffer unit inserted therein; and an elastic element to which the horizontal supporting bar is inserted between the buffer unit and the vertical supporting wall and elastically supports the movement of the buffer unit right and left.

Moreover, the buffer unit includes: a second supporting plate, a moving element which is protrusively formed at the bottom of the second supporting plate and located between the vertical supporting walls of the transportation guide unit, and to which the horizontal guide bar is inserted, and vertical guide bars which are protrusively formed at the upper surface of the second supporting plate apart from each other by a certain distance and to which the terminal fixing unit is inserted movably up and down.

The terminal fixing unit includes: a fixing body to which the vertical guide bar of the buffer unit is inserted and which forms a cavity at its upper surface; a pattern signal supply terminal which is fixed at the cavity in order for its forehead to be protruded from the front surface of the fixing body and electrically connected to the measurement instrument; a cover to which the vertical guide bar is inserted and which covers the upper part of the fixing body; an up-and-down buffer unit which is established at an end of the vertical guide bar and allows the fixing body and the cover to move elastically up and down; and a pair of connecting rods which are protrusively extended from the front surface of the fixing body and attachably/detachably connected to the connector.

The up-and-down buffer unit which allows the fixing body and the cover to move elastically up and down includes: a bolt which is locked at the end of the vertical guide bar, and an elastic element which is located between the upper surface of the cover and the bolt and to which the vertical guide bar is inserted.

Preferably, the connector includes a housing, a pair of connecting holes formed at the surface of the housing facing the connecting rods for the connecting rods to be inserted/escaped, and a pin board having a plurality of connecting pins received in pin holes of the pattern signal supply terminal. The forehead of the connecting rod is tapered and rounded to the outside.

Preferably, the transported pallette is stopped by the stopper at a predetermined working position. The pallette fixing unit is established to the outside from the one frame of the conveyor belt, and pushes and fixes the pallette toward the operator to prevent the pallette from being moved after the pallette stops at the working position. The pallette fixing unit includes: a cylinder which is driven by the air pressure, a moving rod which performs the rectilinear movement by the operation of the cylinder, and an elastic body which is fixed at the forehead of the moving rod. The supporting unit includes: a vertical frame which is fixed at one frame of the conveyor belt movably up and down for controlling the height of the terminal supporting/transporting unit to the connector, and a horizontal frame which is vertically extended from the upper end of the vertical frame to the outside of the one frame of the conveyor belt.

A first connecting bolt is protrusively formed from the one frame of the conveyor belt to the outside, and a first guide hole is formed at the vertical frame so that the fist connecting bolt can be inserted. In addition, a space maintaining unit can be movably connected to the horizontal frame. The space maintaining unit includes a moving plate; and a second connecting bolt which is protrusively formed from the horizontal frame to the upside. A second guide hole is formed at the moving plate so that the second connecting bole can be inserted and guided. At this time, the driving force generating unit is fixed at the moving plate.

The present invention is more specifically described in the following paragraphs by reference to the drawings attached only by way of example.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
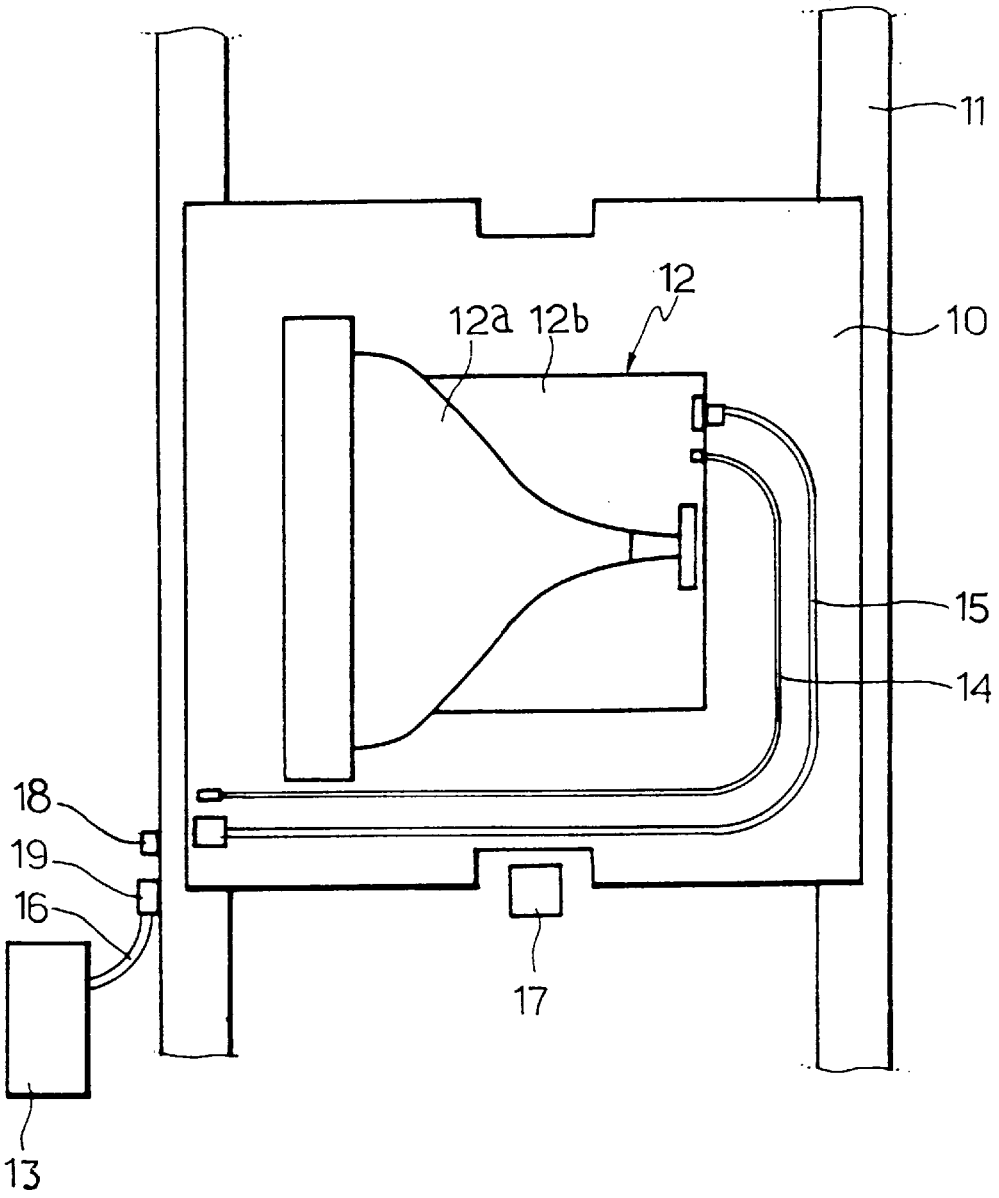
FIG. 1 is a structural view illustrating an apparatus for supplying a test signal necessary for testing and adjusting a video display device.

Referring now to the drawings and particularly to FIG. 1, which illustrates an apparatus for supplying a test signal for testing and adjusting a video display device such as a cathode-ray tube (CRT) in a production assembly line. After an operator of a previous operating line loads a pallette 10 on a pair of conveyor belt 11 and locates the CRT assembly 12 to be tested on the pallette 10 and then transports a conveyor belt 11, the pallette 10 loading the CRT assembly 12 is transported by the conveyor belt 10. The transported pallette 10 is stopped by a stopper 17 established at the center of the two conveyor belts where the apparatus for supplying a test signal is provided.

When the pallette 10 stops, the operator must physically insert or connect a microprocessor cable 14 and a signal cable 15 which are connected to a printed circuit board (PCB) assembly 12*b* of the transported CRT assembly 12 into a microprocessor jack 18 and a signal jack 19 fixed at a frame of the conveyor belt 11. When the microprocessor cable 14 and the signal cable 15 are respectively inserted into the microprocessor jack 18 and the signal jack 19 fixed at the frame of the conveyor belt 11, a variety of test signals for test and adjustment, i.e., the horizontal synchronization signal, vertical synchronization and the DDC signal are supplied from a measurement instrument 13 to the PCB assembly 12*b* through a connection cable 16. Since the test signals for testing and adjusting the screen of the CRT 12*a* are processed by the PCB assembly 12*b* and displayed on the screen of the CRT 12*a*, the operator must perform the necessary testing operations with naked eyes and the measurement instrument 13.

When the testing and adjustments of the CRT 12*a* are completed, the microprocessor cable 14 and the signal cable 15 connected to the microprocessor jack 18 and the signal jack 19 respectively must be manually separated and then loaded on the pallette 10. Afterwards, by operating a switch, the stopper 17 is lowered. The pallette 10 loading the CRT assembly 12 is transported to the next operating line through the conveyor belt 11.

As described previously, the microprocessor cable and the signal cable connected to the CRT assembly on the pallette must manually be inserted into the microprocessor jack and the signal jack fixed at the frame of the conveyor belt. Afterwards, the operator must also manually disconnect and separate the microprocessor cable and the signal cable from the measurement instrument 13. This type of screen testing and adjustment can be extremely cumbersome and inconvenient. Moreover, as the working hours are increased for the operator at the production assembly line, the test time is increased and the production quality is lowered.

Figure 2:
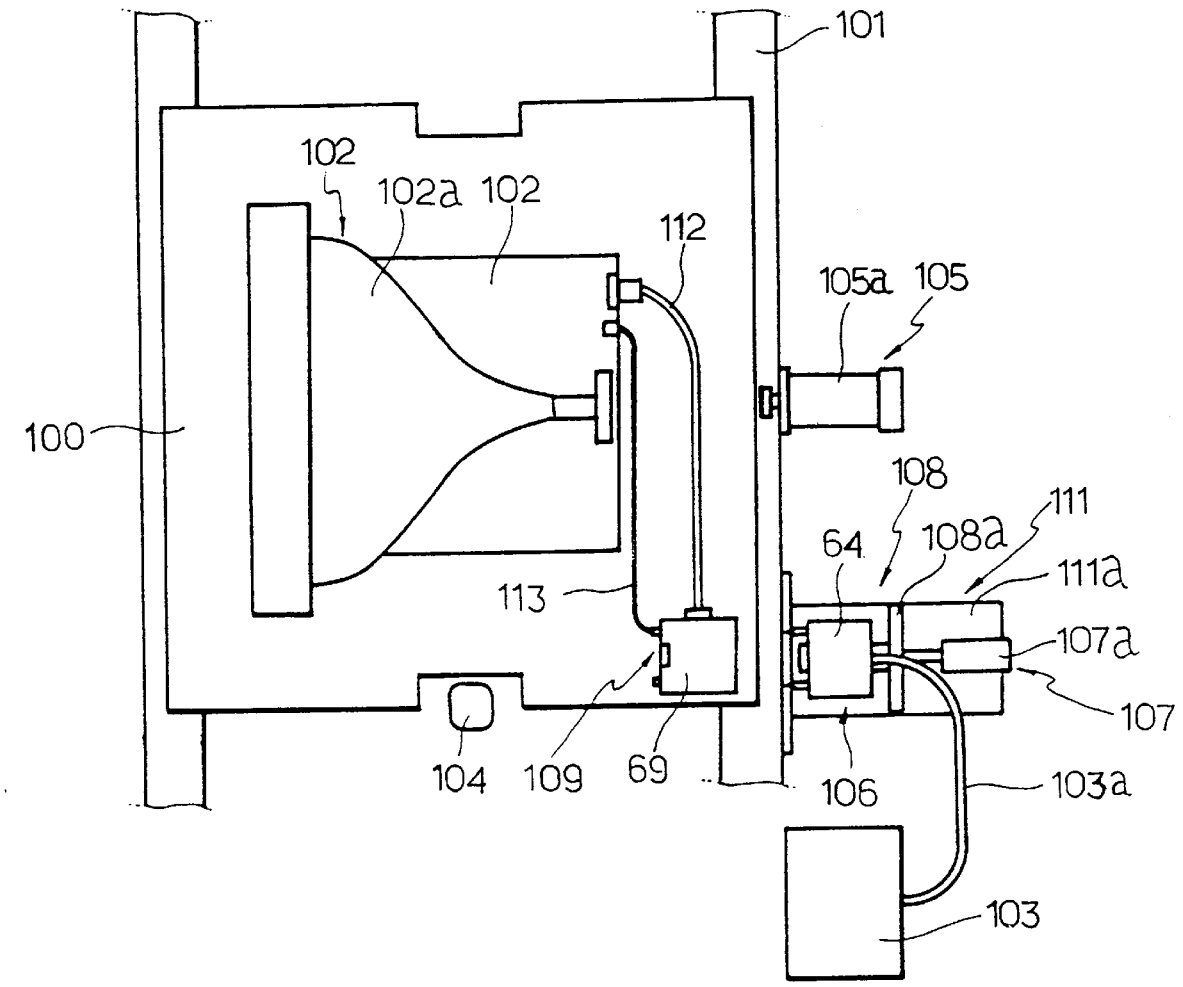
FIG. 2 is a structural view illustrating an apparatus for automatically supplying a test signal for testing and adjusting a video display device constructed according to a preferred embodiment of the present invention.

Turning now to FIG. 2 which illustrates an apparatus for automatically supplying a test signal for testing and adjusting a video display device constructed according to a preferred embodiment of the present invention. The video display device used for testing purposes can be a cathode ray tube (CRT) assembly, a liquid crystal display (LCD), or all types of display receivers. As shown in FIG. 2, the apparatus for automatically supplying a test signal for testing and adjusting a screen of a CRT comprises a pair of conveyor belt 101 which horizontally transport a target object to which the signal is supplied; a rectangular pallette 100 which is transported loading into a pair of the conveyor belts 101; a CRT assembly 102 which is transported loading into the pallette 100; and a stopper 104 which is located at the lower center between a pair of the conveyor belts 101 and stops the transported pallette 100 when the pallette 100 arrives at the working position.

According to the present invention, a pallette fixing unit 105 is further included which is established at one frame 101*a* of the conveyor belt 101 and contacts the pallette 100 to the other frame 101*b* for stably fixing the stopped pallette 100 without movement. In addition, the apparatus for automatically supplying a test pattern signal for test and adjustment further includes a connector which is established to one corner of the pallette 100 and transmits a test pattern signal for testing and adjustment through a signal cable 112 and a microprocessor cable 113 to a printed circuit board (PCB) assembly 102*b* of the CRT assembly 102; a supporting unit 110 which is connected to one main frame 101*a* of the conveyor belt 101 capable of moving up and down and moves vertically to the direction at which the connector 109 is located according to the operator's selection/control; a space maintaining unit 111 which is connected to the upper part of the supporting unit 110 and maintains a proper distance between a pattern signal supply terminal and the connector 109 according to the operator's selection and control; a driving force generating unit 107 which is fixed at one side of the upper part of the space maintaining unit 111 facing the connector 109; a driving force transmitting unit 108 which is connected to the driving force generating unit 107 and transmits the generated driving force; a terminal supporting/transporting unit 106 which is connected to the driving force transmitting unit 108 for receiving the driving force and is connected/separated to/from the connector 109 in order to supply the test pattern signal for testing and adjustment to the connector 109; and a measurement instrument 103 which is electrically connected to the terminal supporting/transporting unit 106 through a cable 103*a* and supplies the test pattern signal for testing and adjustment to the connector 109.

Figure 3:
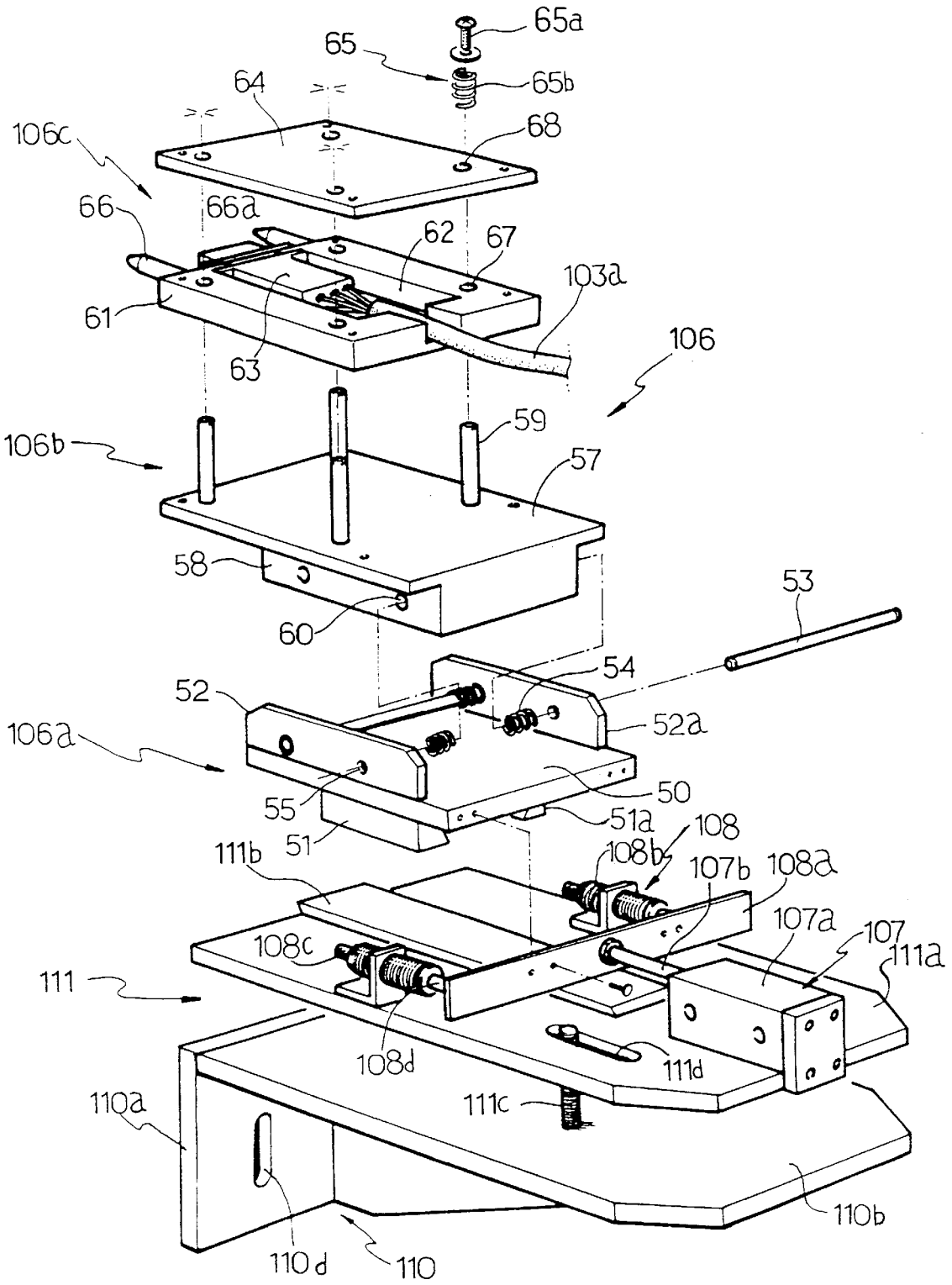
FIG. 3 is a detailed, perspective view illustrating an apparatus for automatically supplying a test signal as shown in FIG. 2.
Figure 4:
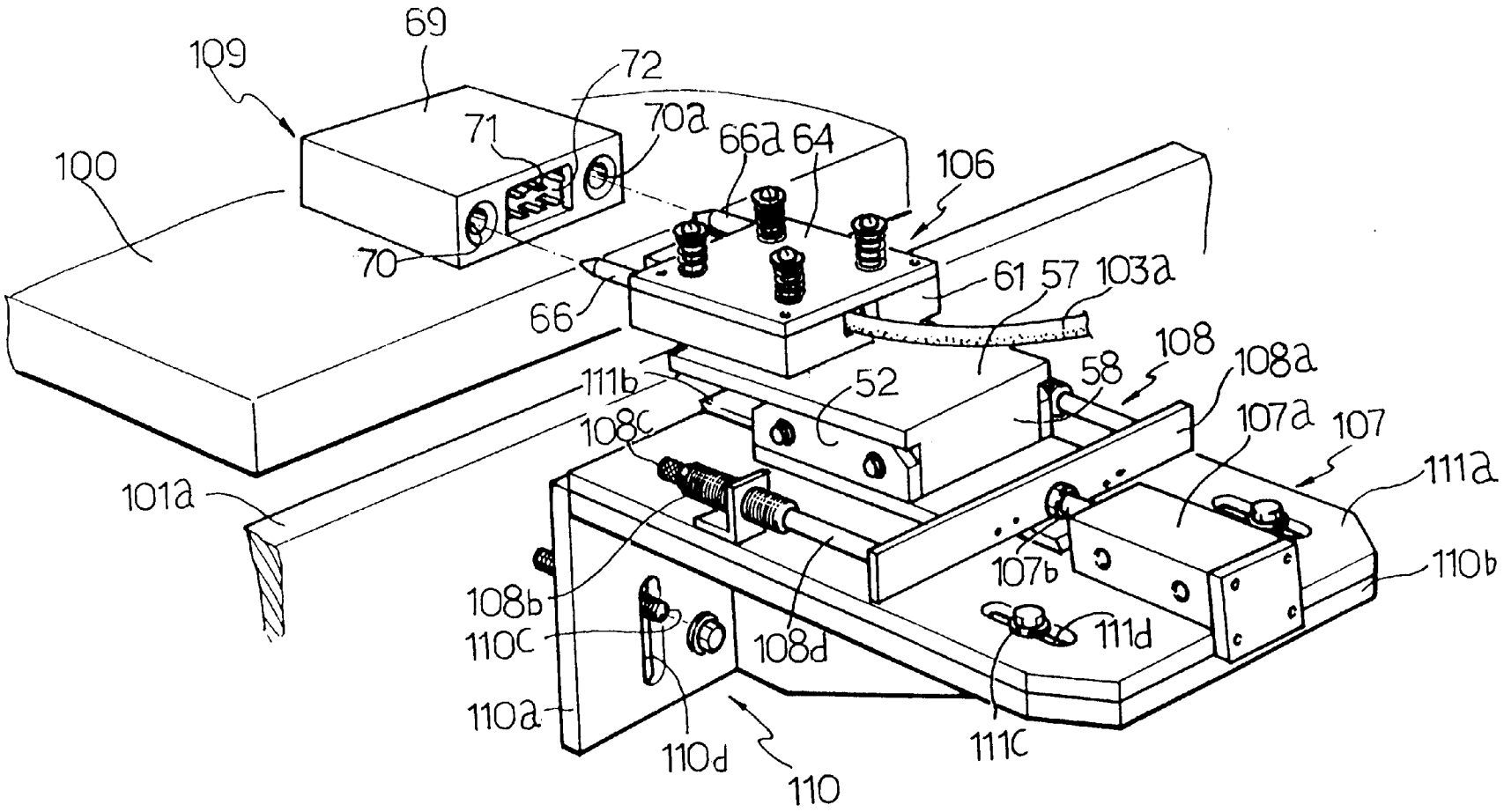
FIG. 4 is a perspective view illustrating a signal connection of an apparatus for automatically supplying a test signal as shown in FIG. 2.
Figure 5A:
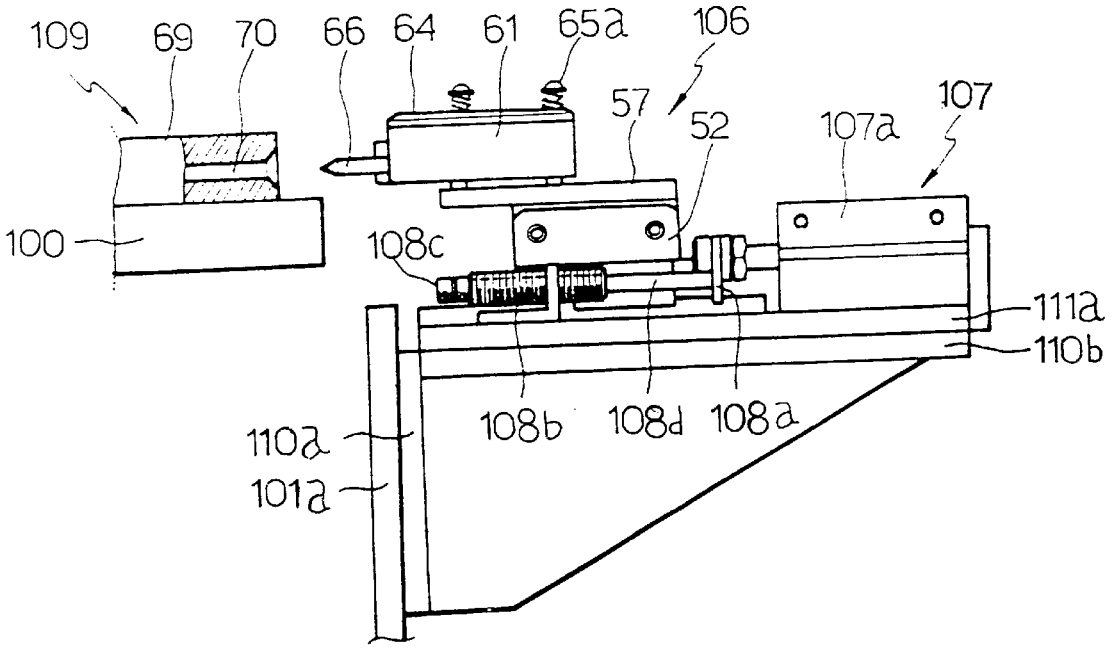
FIG. 5A is a side elevational view illustrating the state before a test signal is supplied to the video display device of FIG. 4.
Figure 5B:
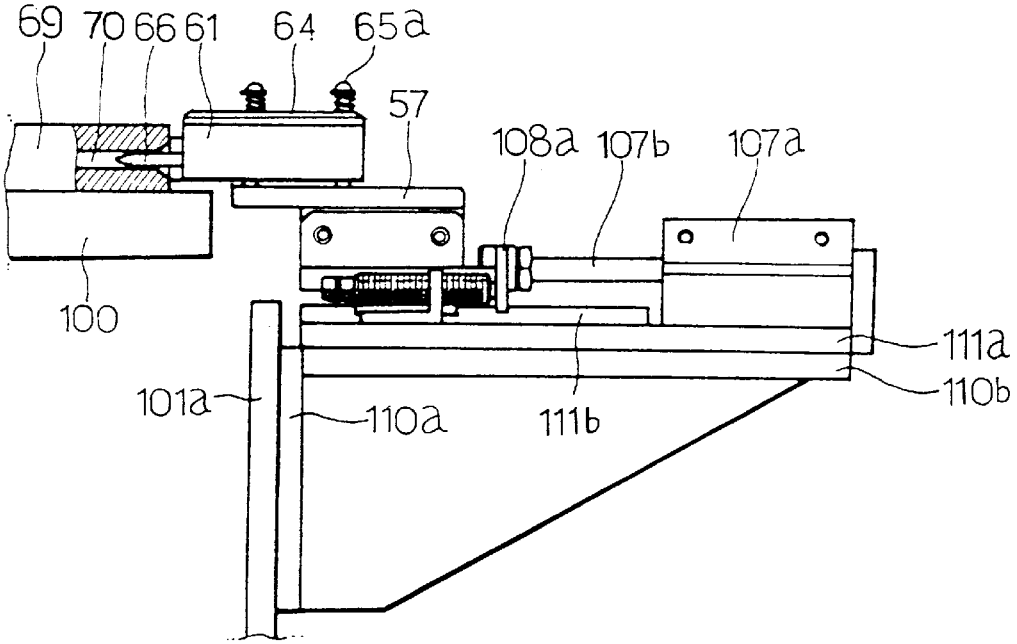
FIG. 5B is a side elevational view illustrating the state that a test signal is supplied to the video display device of FIG. 4.
Figure 6A:
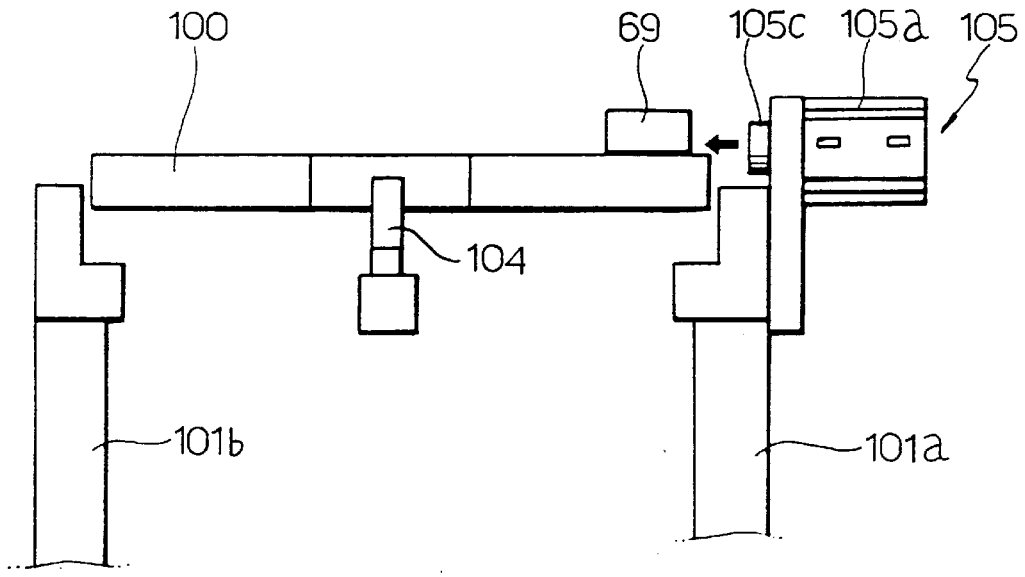
FIG. 6A is an operational view illustrating the state before a pressing unit fixed at a frame of a conveyor belt of FIG. 2 is contacted to a pallette of the conveyor belt and fixes the pallette.
Figure 6B:
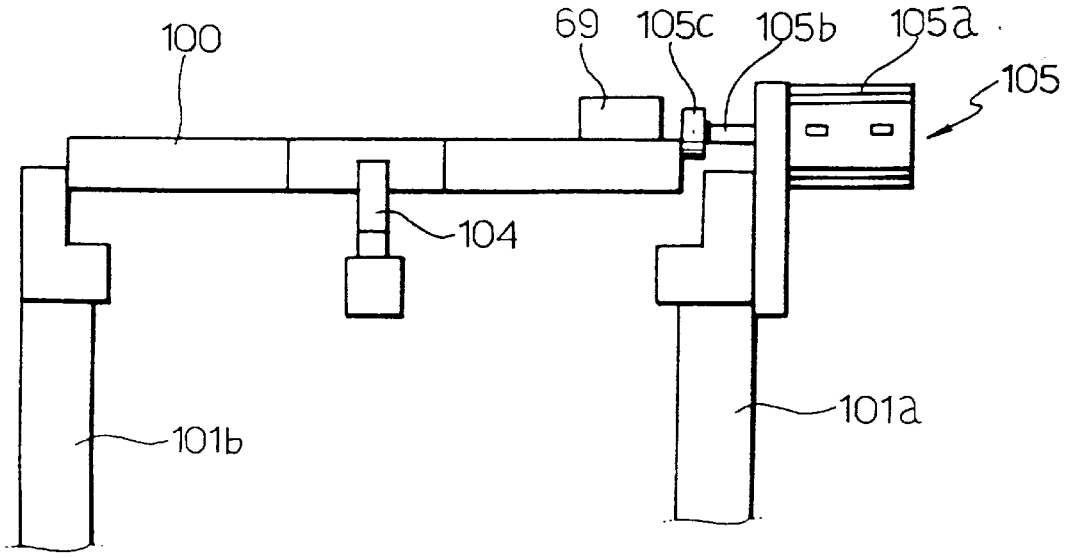
FIG. 6B is an operational view illustrating the state that the pressing unit fixed at the frame of the conveyor belt of FIG. 2 is contacted to the pallette of the conveyor belt and fixes the pallette.

FIG. 3 provides a detailed, perspective view of an apparatus for automatically supplying a test signal as shown in FIG. 2. Likewise, FIG. 4 provides a perspective view of a signal connection of an apparatus for automatically supplying a test signal as shown in FIG. 2. FIGS. 5A–5B are side elevational views of an operational state before and while a test signal is supplied to the video display device of FIG. 4; and FIGS. 6A–6B are side elevational views of an operational state before and while a pressing unit fixed at a frame of a conveyor belt of FIG. 2 is contacted to a pallette of the conveyor belt and fixes the pallette.

As shown in FIGS. 3 and 4, the supporting unit 110 includes a vertical frame 110*a* which is connected to one frame 101*a* of the conveyor belts 101 and moves vertically by a predetermined distance according to the operator's selection and control; and a horizontal frame 110*b* which is horizontally fixed at the upper surface of the vertical frame 110*a* facing the pallette 100 and supports the space maintaining unit 111, the driving force generating unit 107, the driving force transmitting unit 108 and the terminal supporting/transporting unit 106. At the vertical frame 110*a*, a first guide hole 110*d* is formed so that a supporting unit connecting bolt 110*c* protrusively formed at one frame 101*a* of the conveyor belt 101 can penetrate and move vertically. At the horizontal frame 110*b*, a space maintaining unit connecting bolt 111*c* for connecting to the space maintaining unit 111 is protrusively formed.

The driving force generating unit 107 includes a first cylinder 107*a* mounted at one end of the horizontal frame 110*b* of the supporting unit 110; and a piston rod 107*b* which is mounted inside of the first cylinder 107*a* and performs the rectilinear movement by the air pressure.

The space maintaining unit 111 includes a moving plate 111*a* which is connected to the upper surface of the horizontal frame 110*b* of the supporting unit 110 and vertically moves maintaining a predetermined distance to the connector 109 according to the operator's control; and a guide plate 111*b* which is protrusive formed at the center of the upper surface of the moving plate 111*a* in the longitudinal direction and guides the rectilinear movement of the terminal supporting/transporting unit 106. A pair of second guide holes 111*d* are penetratingly formed at both sides of the moving plate 111*a* in the longitudinal direction, and the space maintaining unit connecting bolt 111*c* is inserted into the second guide holes 111*d* for guiding and fixing the moving plate 111*a*.

The driving force transmitting unit 108, as shown in FIG. 3, includes: a pressing unit 108*a* which meets with the guide plate 111*b* of the space maintaining unit 111 orthogonally, whose center part is fixed at one end of the piston rod 107*b* and which performs the rectilinear movement to the connector 109 along the guide plate 111*b* on the moving plate 111*a* by the operation of the first cylinder 107*a*; and a pair of bars 108*d* which are connected to both ends of the moving plate 111*a*. The guide bar 108*d* is slidably inserted into a shock absorbing pipe 108*b* which is connected to a bracket fixed at the moving plate 111*a* with a screw. At one end of the shock absorbing pipe 108*b*, a shock absorption control knob 108*c* is established and closed. As the shock absorption control knob 108*c* rotates, the length from the guide bar 108*d* to the shock absorbing pipe 108*b* is adjusted, and thereby the absorbing capability within the shock absorbing pipe 108*b* can be adjusted.

The terminal supporting/transporting unit 106, as shown in FIG. 3, includes: a transportation guide unit 106*a* which is connected to the pressing unit 108*a* of the driving force transmitting unit 108 and performs the rectilinear movement along the guide plate 111*b* of the moving plate 111*a* by the transmitted driving force; a buffer unit 106*b* which is elastically connected to the upper part of the transportation guide unit 106*a* and moves right and left; and a terminal fixing unit 106*c* which moves up and down being connected elastically to the upper part of the buffer unit 106*b* and electrically connected to the measurement instrument 103 and fixes the pattern signal supply terminal 63 connected to the connector 109 of the pallette 100.

The transportation guide unit 106*a*, as shown FIG. 3, includes: a rectangular supporting plate 50 which is fixed at the pressing unit 108*a* of the driving force transmitting unit 108 with the screw; a pair of guide rails 51 and 51*a* which are formed at the bottom of the supporting plate 50 in the longitudinal direction apart from each other by a certain distance and slidably connected to the guide plate 111*b* on the horizontal frame 111*a* of the space maintaining unit 111; a pair of vertical supporting walls 52 and 52*a* which are vertically protruded in the longitudinal direction at both sides of the upper surface of the supporting plate 50 and each having a pair of through holes 55; a pair of horizontal supporting bars 53 which are inserted/fixed into/at the through hole 55 between a pair of the vertical supporting walls 52 and 52*a* and fixes the buffer unit 106*b* movably right and left; and a coil spring 54 to which the horizontal supporting bar 53 is inserted between the vertical supporting walls 52 and 52*a* and the buffer unit 106*b*.

The buffer unit 106*b*, as shown in FIG. 3, includes: a rectangular supporting plate 57 which is attached to the upper part of the transportation guide unit 106*a*; a moving unit 58 which is protrusively formed at the bottom of the supporting plate 57, located between the vertical supporting walls 52 and 52*a* of the transportation guide unit 106*a*, and has a through hole 60 to which the horizontal supporting bar 53 is inserted; and a vertical guide bars 59 which are protrusively formed at the upper surface of the supporting plate 57 apart from each other by a certain distance in the vertical direction to the supporting plate 57 and are inserted so that the terminal fixing unit 106*c* can move up and down.

In addition, the terminal fixing unit 106*c*, as shown in FIG. 3, includes: a rectangular fixing body 61 which has a through hole 67 at each corner, to which vertical guide bars 59 of the buffer unit 106*b* are inserted movable up and down, and which has a cavity 62 inside thereof; a pattern signal supply terminal 63 which is established at the cavity 62 formed on the upper surface of the fixing body 61, whose forehead is protruded from the forehead of the fixing body 61, and which supplies the pattern signal for test and adjustment to the connector 109 of the pallette 100 by being electrically connected to the measurement instrument 103 through the cable 103*a*; a rectangular cover 64 which is fixed at the upper surface of the fixing body 61, has a through hole 68 at each corner corresponding to the through holes 67 of the fixing body 61, and to which the vertical guide bar 59 is inserted movably up and down; an up-and-down buffer unit 65 which is comprised of a coil spring 65*b* to which the vertical guide bar 59 is inserted and a bolt 65*a* so that the fixing body 61 and the cover 64 which are connected mutually can be inserted by the vertical guide bar 59 and elastically move up and down; and a pair of connecting rods 66 and 66*a* which are protrusively formed at the forehead of the fixing body 61 apart from each other by a certain distance facing the connector 109 and are connected/separated to/from the connector 109.

As shown in FIGS. 4 and 5A–5B, the connector 109 includes: a connector housing 69 which is fixed at the one edge of the pallette 100 and has a pair of connecting holes 70 and 70*a* at a surface facing the connecting rods 66 and 66*b* so that the connecting rods 66 and 66*a* of the fixing body 61 can be inserted/escaped to/from; and a pin board 71 which is established between the connecting holes 70 and 70*a* and has connecting pins which are inserted into pin holes of the pattern signal supply terminal 63.

The pallette fixing unit 105, as shown in FIGS. 6A and 6B, includes: a second cylinder 105*a* which performs the rectilinear movement by the air pressure; a moving rod 105*b*; an elastic body 105*c* which is fixed at the forehead of the moving rod 105*a* and elastically pushes the pallette 100 to the other frame 101*b* of the conveyor belt 101 by the operation of the second cylinder 105*a*.

Now the operation of an apparatus for automatically supplying a test pattern signal for testing and adjusting a screen of a CRT assembly according to the present invention will be described in detail with reference to FIGS. 2 to 6B hereinbelow.

First, when the operator of the previous operating line loads the pallette 100 on a pair of conveyor belts 101 and loads the CRT assembly 102 to be tested on the pallette 100 and then moves the conveyor belt 101, the pallette 100 loading the CRT assembly 102 is transported by the conveyor belts 101. The transported pallette 100, as shown in FIG. 2, is stopped by the stopper 104 located at the center between the pair of the conveyor belt 101 at the position where the operator is located in which the apparatus for automatically supplying a test pattern signal is provided.

As shown in FIG. 2, when the pallette 100 is stopped by the stopper 104, the pallette fixing unit 105 fixed at the one frame 101*a* of the conveyor belt 101 is operated and the pallette 100 is pushed toward the other frame 101*b* of the conveyor belt 101, i.e., toward the direction at which the operator is located, and thereby the pallette 100 is fixed.

As shown in FIGS. 6A and 6B, the pallette fixing unit 105 includes: the second cylinder 105*a* for performing the rectilinear movement by the air pressure, the piston rod 105*b*, and the elastic body 105*c* which is attached at the end of the piston rod 105*b*. Initially, the piston rod 105*b* is in a backward state as shown in FIG. 6A. When the pallette 100 is stopped by the stopper 104, the piston rod is forwarded by the pressure of the air which is flown into the air pressure hose (not shown). Accordingly, the elastic body 105*c* fixed at the end of the piston rod 105*b* presses and pushes the pallette 100 to the other frame 101*b*, thereby fixing the pallette 100, as shown in FIG. 6B.

When the pallette 100 is pushed to the other frame 101*b* by the operation of the piston rod 105*b*, a repelling power is occurred. At this time, the elastic body 105*c* absorbs the repelling power and the pallette 100 is stably fixed at once without movement. When the pallette 100 is stably fixed to the other frame 101*b* by the pallette fixing unit 105, the operator pushes a start switch such as a push button switch (not shown) for driving the apparatus for automatically supplying the test pattern signal according to the present invention.

When the start switch is turned on, the measurement instrument 103, the driving force transmitting unit 108 and the terminal supporting/transporting unit 106 are operated by the driving force generated by the driving force generating unit 107. Afterwards, the test pattern signal for testing and adjusting the screen of the CRT which is generated by the measurement instrument 103 is supplied to the connector 109 located at the upper surface of the pallette 100. In other words, the pattern signal for testing and adjusting the screen of the CRT is supplied in the following order. First, when the start switch is turned on by the operator, the piston rod 107*b* performs the forward movement by the air pressure flown from the compressing unit (not shown) into the first cylinder 107*a* of the driving force generating unit 107 fixed at the moving plate 111*a* of the space maintaining unit 111. Accordingly, the pressing unit 108*a* of the driving force transmitting unit 108 fixed at the forehead of the piston rod 107*b* is pushed. At this time, when the guide bars 108*d* formed at both sides of the pressing unit 108*a* perform a rapid forward movement within the shock absorbing pipe 108*b*, a strong repelling power against the forward movement is generated. As a result, a momentous forward movement of the guide bar 108*d* is buffered.

When the pressing unit 108*a* whose momentous movement is mitigated by the absorbing operation of the shock absorbing pipe 108*b*, the terminal supporting/transporting unit 106 which is connected to the pressing unit 108*a* with the screw is forwarded along the guide plate 111*b*, thereby being connected to the connector 109 of the pallette 100. In other words, the transportation guide unit 106*a* of the terminal supporting/transporting unit 106 is connected to the pressing unit 108*a* of the driving force transmitting unit 108 with the screw, and the buffer unit 106*b* is elastically connected to the upper part of the transportation guide unit 106*a* movably right and left. Moreover, the terminal fixing unit 106*c* is elastically connected to the upper part of the buffer unit 106*b* movably up and down. Accordingly, owing to the forward movement of the pressing unit 108*a*, the pattern signal supply terminal 63 is connected to the connector 109 of the pallette 100.

The operations of the transportation guide unit 106*a*, buffer unit 106*b* and the terminal fixing unit 106*c* will be explained in detail with reference to FIG. 3 as follows.

First, the supporting plate 50 of the transportation guide unit 106*a* which is connected to the pressing unit 108*a* of the driving force transmitting unit 108 with the screw is slidably connected to the guide plate 111*b* of the moving plate 111*a* by a pair of the guide rails 51*a* and 51*b*, and moves toward the connector 109 along the guide plate 111*b*. In order to prevent the guide rails 51*a* and 51*b* formed at the bottom of the supporting plate 50 from being escaped from the guide plate 111*b* formed at the center of the moving plate 111*a* in the longitudinal direction, the inner surfaces of the guide rails 51 and 51*a* which are facing each other are tapered by a certain angle. On the contrary, both surfaces of the guide plate 111*b* facing the guide rails 51*a* and 51*b* are tapered in the other way. Accordingly, once the guide rails 51*a* and 51*b* are inserted into the guide plate 111*b*, the guide plate 111*b* is not escaped from the guide rails 51*a* and 51*b* during the transportation.

Afterwards, when the supporting plate 50 of the transportation guide unit 106*a* performs the forward movement along the guide plate 111*b*, the buffer unit 106*b* which is located between a pair of the vertical supporting walls 52 and 52*a* and elastically connected to the supporting plate 50 by the horizontal supporting bar 53 and the coil spring 54 performs the forward movement together with the transportation guide unit 106*a*.

As described, since the terminal fixing unit 106*c* is elastically connected to the upper part of the buffer unit 106*b*, when the right/left mobility is transmitted from the terminal fixing unit 106*c*, a slight movement to right and left can be occurred by the electricity of the coil spring to which the horizontal supporting bar 53 is inserted between the moving unit 58 and vertical supporting walls 52*a* and 52*b*. Here, the right/left mobility is generated when the connecting rods 66*a* and 66*b* of the terminal fixing unit 106*c* is connected to the connecting holes 70*a* and 70*b* of the connector 109 without suitably adjusting the vertical or horizontal positions.

When the buffer unit 106*b* performs the forward movement by the supporting plate 50, the fixing body 61 and cover 64 to which the four vertical guide bars 59 fixed vertically at the upper surface of the supporting plate 57 are inserted movably up and down through the through hole 67 and which are connected to the supporting plate 57 by the up-and-down buffer unit 65 move simultaneously forward.

The electrical connection between the terminal fixing unit 106*a* and the connector 109 of the pallette 100 will now be described with reference to FIGS. 5A and 5B as follow. As shown in FIG. 5A, since the terminal supporting/transporting unit 106 and the connector 109 maintain a certain distance and the transportation guide unit 106*a*, the buffer unit 106*b* and the terminal fixing unit 106*c* move as aforesaid by the driving force of the driving force generating unit 107, two connecting rods 66*a* and 66*b* protrusively formed at the forehead of the fixing body 61 move forward together with the fixing body 61, as shown in FIG. 5B. Afterwards, the connecting rods 66*a* and 66*b* are inserted into the connecting holes 70 and 70*a* formed at the connector housing 69 of the connector 109.

Moreover, as shown in FIGS. 4 and 5B, the pattern signal supply terminal 63 which is connected to the cavity 62 of the fixing body 61 and connected to the measurement instrument 103 for generating a test pattern signal for testing and adjustment through the cable 103*a* moves forward together with the fixing body 61 and is inserted into a pin board groove 72 formed at the front surface of the connector housing 69. As a result, connecting pins of the pin board 71 are inserted into the pin holes of the pattern signal supply terminal 63, and thereby they are electrically connected.

When the terminal fixing unit 106*c* of the terminal supporting/transporting unit 106 is electrically connected to the connector 109 of the pallette 100, the connecting rods 66*a* and 66*b* of the terminal fixing unit 106*c* are firstly inserted into the connecting holes 70*a* and 70*b* of the housing 69 of the connector 109. At this time, in the case that the horizontal positions or the vertical positions are not suitably adjusted, the connecting rods 66 and 66*c* are contacted to the inner surfaces of the connecting holes 70*a* and 70*b* having a certain frictional force. The mobility in every direction caused by the frictional force is transmitted to the terminal fixing unit 106*c* and the buffer unit 106*b*. In the case that the transmitted mobility is up-and-down direction, as shown in FIG. 3, the fixing body 61 and the cover 64 of the terminal fixing unit 106*c* inserted by the vertical guide bar 59 of the supporting plate 57 and fixed by the coil spring 65*b* and the bolt 65*a* of the up-and-down buffer unit 65 elastically move up and down as much as the transmitted frictional force based on the vertical guide bar 59.

When the transmitted mobility is the right and left direction, the buffer unit 106*b* moves right or left by the elastic unit such as the coil spring 54 based on a pair of the horizontal supporting bars 53. As a result, even in the case that the connection position of the terminal fixing unit 106*c* of the terminal supporting/transporting unit 106 with the housing 69 of the connector 109 is slightly misaligned, the connecting rods 66*a* and 66*b* can be inserted into the connecting holes 70*a* and 70*b* without large frictional force by the up and down or right and left mobility of the terminal fixing unit 106*c* and the buffer unit 106*b*.

To connect the terminal supporting/transporting unit 106 to the connector 109 smoothly, as shown in FIGS. 5A and 5B, the foreheads of the connecting rods 66 and 66*a* are tapered and the foreheads of the connecting holes 70 and 70*a* are rounded. In the case that the terminal fixing unit 106*c* of the terminal supporting/transporting unit 106 is not level with the housing 69 of the connector 109 due to the different heights, the operator can adjust the heights so as to level each other. In other words, the supporting unit 110 includes the vertical frame 110*a* connected to the frame 101*a* and the horizontal frame 110*b*. At the vertical frame 110*a*, the first guide hole 110*d* is formed for connecting movably up and down to the frame 101*a* by the locking unit such as the connecting bolt 110*c*.

Accordingly, in the case that the connecting rods 66*a* and 66*b* are not inserted into the corresponding connecting holes 70*a* and 70*b* due to the different heights of the housing 69 of the connector 109 and the terminal fixing unit 106*c* of the terminal supporting/transporting unit 106, the operator, as shown in FIG. 4, unlocks the connecting bolt 110*c* loosely and holds and pushes the vertical frame 110*a* upwardly based on the connecting bolt 110*c*. At this time, the vertical frame 110*a* moves upwardly according to the first guide hole 110*d*, and the horizontal frame 110*b* and the terminal supporting/transporting unit 106 also move upwardly.

When the connecting holes 70 and 70*a* of the housing 69 and the connecting rods 66 and 66*a* are located vertically along a line after pushing the vertical frame 110*a* upwardly, the connecting bolt 110*c* which is unlocked is tightened and the vertical frame 110*a* is fixed at the frame 101*a*. In the case that the distance between the connector 109 and the terminal supporting/transporting unit 106 is farther or nearer than a predetermined distance, the size of the pallette 100 varies according to the screen size of a CRT 102*a*. As a result, since the position where the connector 109 is established becomes different, the connection distance becomes improper.

In order to solve this problem, as shown in FIGS. 3 and 4, the distance can be controlled by moving the space maintaining unit 111 facing the connector 109 forward and backward. The space maintaining unit 111 includes the moving plate 111*a* connected to the terminal supporting/transporting unit 106 and the guide plate 111*b* formed at the center of the moving plate 111*a* in the longitudinal direction. At both sides of the one end of the space maintaining unit 111, a pair of the second guide holes 111*d* are formed, and the moving plate 111*a* is connected movably right and left to the upper surface of the horizontal frame 110*b* of the supporting unit 110 by the locking unit such as the connecting bolt 111*c*.

Accordingly, in the case that the distance between the housing 69 of the connector 109 and the terminal fixing unit 106*c* of the terminal supporting/transporting unit 106 is improperly adjusted and they are not therefore completely connected, as shown in FIGS. 3 and 4, the operator unlocks the connecting bolt 111*c* and pushes or pulls the moving plate 111*a* to be suitable to the certain distance. At this time, the moving plate 111*a* moves forward and backward by the second guide hole 111*d* based on the connecting bolt 111*c*.

After maintaining a proper distance between the connecting rods 66 and 66*a* of the terminal fixing unit 106*c* and the housing 69 of the connector 109 by moving the moving plate 111*c* forward and backward, the connecting bolt 111*c* which is unlocked is also tightened and the moving plate 111*a* is stably fixed at the vertical frame 110*b*. In addition, the strength of the driving force which is generated by the driving force generating unit 107 and transmitted to the pressing unit 108*a* of the driving force transmitting unit 108 is related to the time taken when the terminal supporting/transporting unit 106 is connected to the connector 109. That is, in the case that the driving force is too strong, it has a benefit in that the terminal supporting/transporting unit 106 is momentarily connected to the connector 109 without being delayed by the horizontal movement. However, component parts can be broken down due to the momentary connection.

On the contrary, in the case that the driving force is too weak, the terminal supporting/transporting unit 106 is moved and connected to the connector 109 so slowly. At this time, the driving force can be controlled through the shock absorption control knob 108*c* of the shock absorbing pipe 108*b*. In other words, when the shock absorption control knob 108*c* established at the end of the shock absorbing pipe 108*b* is turned, the shock absorbing pipe 108*b* having screw threads at its circumferential surface moves forward and backward based on the bracket and controls the driving force of the pressing unit 108*a* fixed at the forehead of the guide bar 108*d*, and thereby the traveling speed can be controlled.

As described, when the terminal supporting/transporting unit 106 is electrically connected to the connector 109, the test pattern signal for testing and adjusting the screen is generated by the measurement instrument 103. This pattern signal passes through the pattern signal supply terminal 63 of the terminal fixing unit 106*c* and the pin board 71 of the housing 69. Afterwards, the pattern signal is transmitted to the PCB assembly 102*b* of the CRT assembly 102 through the signal cable 112 and the microprocessor cable 113 shown in FIG. 2, and then displayed on the screen of the CRT 102*a*. Accordingly, the operator checks and tests the pattern signal with naked eyes and performs necessary adjusting operations.

When the adjusting operations are completed, the first cylinder 107*a* and the piston rod 107*b* attached thereto move backward by the suction operation to the air pressure hose. In addition, due to the backward movement of the pressing unit 108*a* fixed at the forehead of the piston rod 107*b*, the transportation guide unit 106*a*, buffer unit 106*b* and the terminal fixing unit 106*c* of the terminal supporting/transporting unit 106 move backward. Accordingly, the connecting rods 66 and 66*a* of the terminal fixing unit 106*c* and the pattern signal supply terminal 63 are escaped from the connecting holes 70 and 70*a* and the pin board 71 of the connector 109, respectively. As a result, the terminal supporting/transporting unit 106 is separated from the connector 109.

When the terminal supporting/transporting unit 106 is separated from the connector 109 of the pallette 100, the stopper 104 is automatically lowered, and thereby the pallette 100 on which the CRT assembly 102 is loaded is transported to the next operating line through the conveyor belts 101.

The space maintaining unit 111 is explained as above. However, the terminal supporting/transporting unit 106 can be used by directly providing the guide plate 111*b* at the horizontal frame 110*b* of the supporting unit 110 without establishing the space maintaining unit 111. It is also possible to fix the horizontal frame 110*b* of the supporting unit 110 directly to the frame 101*a* of the conveyor belt 101 without adjusting the height. At this time, it is essential to accurately adjust the connection position of the connector 109 and the terminal supporting/transporting unit 106 when establishing the apparatus for automatically supplying the signal according to the present invention. In this case, since the space maintaining unit 111 and the supporting unit 110 are not required, the production price of the CRT assembly can be reduced.

In contrast to the conventional arts in which the operator manually connects the microprocessor cable and the signal cable connected to the CRT assembly on the pallette directly to a connecting apparatus fixed at the frame of the conveyor belt and supplies the pattern signal for test and adjustment, the present invention automatically provides a test pattern signal for testing and adjustment from the measurement instrument through the apparatus for automatically supplying the signal and automatically blocks the pattern signal after the operation is completed. Accordingly, unnecessary manual operations are reduced when the pattern signal for testing and adjusting the screen from the measurement instrument is supplied to the CRT assembly transported on the pallette in the production assembly line. In addition, productivity is enhanced and reduction of working hours is realized.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. A method for automatically supplying a pattern signal generated from a measurement instrument for testing and adjusting a screen of a video display device loaded on a pallette driven in a production assembly line, comprising the steps of:

stopping said pallette having a connector fixed thereon and electrically connected to said video display device at a designated operating position in said production assembly line;

automatically coupling a terminal supporting/transporting unit electrically connected to said measurement instrument at said designated operating position to said connector fixed on said pallette for electrical connection to said video display device;

displaying said pattern signal for testing and adjusting the screen of said video display device by supplying said pattern signal to said video display device from said measurement instrument via said connector coupled to said terminal supporting/transporting unit; and after testing and adjusting the screen of said video display device, separating said terminal supporting/transporting unit from said connector and transporting said pallette to a next operating line.

2. The method of claim 1, further comprising a step of adjusting said pallette to a predetermined position after said pallette stops at said designated operating position in said production assembly line.

3. A method for automatically supplying a pattern signal generated from a measurement instrument for testing and adjusting a screen of a video display device transported on a pallette in a production assembly line, comprising the steps of:

stopping said pallette having a connector fixed thereon and electrically connected to said video display device at a designated operating position during transportation along said production assembly line;

adjusting a connection position of a terminal supporting/transporting unit which is electrically connected to said measurement instrument to said connector fixed on said pallette;

adjusting a connection distance of said terminal supporting/transporting unit to said connector according to said video display device;

connecting said terminal supporting/transporting unit to said connector by electrically moving said terminal supporting/transporting unit by a certain distance;

displaying said pattern signal for testing and adjusting the screen of said video display device by supplying said pattern signal to said video display device via said connector connected to said terminal supporting/transporting unit; and after testing and adjusting the screen of said video display device, separating said terminal supporting/transporting unit from said connector and transporting said pallette to a next operating line.

4. The method of claim 3, wherein, at said step of adjusting the connecting position of said terminal supporting/transporting unit to said connector, the position of said terminal supporting/transporting unit is adjusted in every direction so as to be accurately connected to said connector.

5. The method of claim 3, wherein, at said step of adjusting the connection distance of said terminal supporting/transporting unit to said connector, the connection distance of said connector and terminal supporting/transporting unit is adjusted based on the position of said connector established corresponding to the size of said pallette which varies according to the screen size of said video display device.

6. An apparatus for automatically supplying a pattern signal for testing and adjusting a screen of a video display device transported on a pallette in a production assembly line, comprising:

a connector fixed on said pallette and electrically connected to said video display device;

a supporting unit extended to the outer side from one frame of said conveyor belt facing said pallette;

a driving force generating unit fixed at said supporting unit facing said connector for generating driving force;

a driving force transmitting unit for transmitting the driving force generated by said driving force generating unit;

a terminal supporting/transporting unit fixed at said driving force transmitting unit maintaining a certain distance to said connector and electrically connected/separated to/from said connector through a rectilinear movement generated by the driving force; and a measurement instrument connected electrically to said terminal supporting/transporting unit, for generating the pattern signal for testing and adjusting the screen of said video display device.

7. The apparatus of claim 6, wherein said driving force generating unit comprises:

a cylinder mounted on said supporting unit; and a piston rod for facilitating the rectilinear movement from said cylinder.

8. The apparatus of claim 7, wherein said driving force transmitting unit comprises:

a pressing unit fixed at the forehead of said piston rod, and performs the rectilinear movement toward said connector along the upper surface of said supporting unit by the operation of said cylinder;

a shock absorbing unit for absorbing the driving force of said pressing unit; and a guide plate protrusively formed at the center of an upper surface of said supporting unit in a longitudinal direction, and guides the rectilinear movement of said terminal supporting/transporting unit.

9. The apparatus of claim 8, wherein said shock absorbing unit comprises:

a pair of guide bars fixed at both ends of said pressing unit in the longitudinal direction; and a shock absorbing pipe which has one end to which said guide bar is slidably inserted and the other end which is closed, forms a screw at the outer peripheral surface and is connected to a bracket fixed on the upper surface of said supporting unit with the screw.

10. The apparatus of claim 8, wherein said shock absorbing unit further comprises a shock absorption control unit for controlling the shock absorbing capability of said shock absorbing unit.

11. The apparatus of claim 10, wherein said shock absorption control unit is a knob attached to the other end of said shock absorbing pipe.

12. The apparatus of claim 8, wherein said terminal supporting/transporting unit comprises:

a transportation guide unit attached to said pressing unit, and performs the rectilinear movement toward said connector along said guide plate by the transmitted driving force;

a buffer unit elastically connected to said transportation guide unit, and moves right and left when said transportation guide unit performs the rectilinear movement; and a terminal fixing unit electrically connected to said measurement instrument and elastically connected to an upper portion of said buffer unit, and connects to and separates from said connector by moving up and down, when said transportation guide unit performs the rectilinear movement.

13. The apparatus of claim 12, wherein said transportation guide unit comprises:

a first supporting plate fixed at said pressing unit of said driving force transmitting unit;

a pair of guide rails formed at the bottom of said first supporting plate apart from each other by a certain distance and connected slidably to said guide plate of said supporting unit;

vertical supporting walls protrusively formed upwardly at both ends of the upper surface of said first supporting plate;

a horizontal supporting bar having both ends fixed at said vertical supporting walls, and supports said buffer unit inserted therein; and an elastic element to which said horizontal supporting bar is inserted between said buffer unit and vertical supporting wall and elastically supports the movement of said buffer unit right and left.

14. The apparatus of claim 13, wherein said buffer unit comprises:

a second supporting plate;

a moving element protrusively formed at the bottom of said second supporting plate and located between said vertical supporting walls of said transportation guide unit, and to which said horizontal guide bar is inserted; and vertical guide bars protrusively formed at the upper surface of said second supporting plate apart from each other by a certain distance and to which said terminal fixing unit is inserted movably up and down.

15. The apparatus of claim 14, wherein said terminal fixing unit comprises:

a fixing body to which said vertical guide bar of said buffer unit is inserted and which forms a cavity at its upper surface;

a pattern signal supply terminal fixed at said cavity and protruded from said fixing body and electrically connected to said measurement instrument;

a cover to which said vertical guide bar is inserted and which covers an upper portion of said fixing body;

an up-and-down buffer unit established at an end of said vertical guide bar, and allows said fixing body and cover to move elastically up and down; and a pair of connecting rods protrusively extended from said fixing body and attachably/detachably connected to said connector.

16. The apparatus of claim 15, wherein said up-and-down buffer unit comprises:

a bolt locked at the end of said vertical guide bar; and an elastic element located between an upper surface of said cover and said bolt and to which said vertical guide bar is inserted.

17. The apparatus of claim 16, wherein said connector comprises:

a housing;

a pair of connecting holes formed at the surface of said housing facing said connecting rods in order for said connecting rods to be inserted/escaped; and a pin board having a plurality of connecting pins coupled to pin holes of said pattern signal supply terminal.

18. The apparatus of claim 17, wherein the forehead of said connecting rod is tapered.

19. The apparatus of claim 18, wherein the forehead of said connecting hole is rounded.

20. The apparatus of claim 6, further comprising a stopper for stopping said pallette which is transported at a designated operating position in a production assembly line.

21. The apparatus of claim 6, further comprising a pallette fixing unit extended to the outside from said one frame of said conveyor belt and pushes to fix said pallette toward an operator in order to prevent said pallette from being moved after said pallette stops at said designated operating position.

22. The apparatus of claim 21, wherein said pallette fixing unit comprises:

a cylinder driven by the air pressure;

a moving rod for performing the rectilinear movement by the operation of said cylinder; and an elastic body fixed at the forehead of said moving rod.

23. The apparatus of claim 6, wherein said supporting unit comprises:

a vertical frame fixed at one frame of said conveyor belt movably up and down for controlling the height of said terminal supporting/transporting unit to said connector; and a horizontal frame vertically extended from an upper end of said vertical frame to the outside of the one frame of said conveyor belt.

24. The apparatus of claim 23, wherein a first connecting bolt is protrusively formed from said one frame of said conveyor belt to the outside, and a first guide hole is formed at said vertical frame in order said first connecting bolt to be inserted therein.

25. The apparatus of claim 23, further comprising a space maintaining unit which is movably connected to said horizontal frame.

26. The apparatus of claim 25, wherein said space maintaining unit comprises:

a moving plate;

a second connecting bolt protrusively formed from said horizontal frame to the upside; and a second guide hole formed at said moving plate in order for said second connecting bole to be inserted and guided therein.

27. The apparatus of claim 26, wherein said driving force generating unit is fixed at said moving plate.

* * * * *